US005373586A

United States Patent [19]

Brosnan

[11] Patent Number: 5,373,586

[45] Date of Patent: Dec. 20, 1994

[54] SPORTS CAP WITH REPLACEABLE FRONT GORE

[76] Inventor: Patrick J. Brosnan, 4464 Elan Ct., Annandale, Va. 22003

[21] Appl. No.: 45,730

[22] Filed: Apr. 14, 1993

[51] Int. Cl.[5] ..... A42B 1/24

[52] U.S. Cl. ..... 2/195.1; 2/209.12; 2/918

[58] Field of Search ..... 2/171.1, 172, 185 R, 2/186, 195, 196, 199, 209.1, DIG. 6, 171, 209.11, 209.12, 209.13, 175.1, 175.3, 195.1, 918

[56] References Cited

U.S. PATENT DOCUMENTS

| | | | |
|---|---|---|---|
| 4,312,076 | 1/1982 | Gamm | 2/199 |
| 4,776,043 | 10/1988 | Coleman | 2/185 R |
| 5,070,545 | 12/1991 | Tapia | 2/171.1 |

*Primary Examiner*—Clifford D. Crowder
*Assistant Examiner*—Diana L. Biefeld
*Attorney, Agent, or Firm*—William L. Klima

[57] ABSTRACT

A sports cap with a replaceable tradename/logo panel to allow one cap to be worn bearing different tradenames/logos on different occasions as desired.

8 Claims, 1 Drawing Sheet

SPORTS CAP WITH REPLACEABLE FRONT GORE

BACKGROUND OF THE INVENTION

1. Field of the Invention

The invention is directed to a sports cap having variable display indicia.

2. Prior Art

Sport caps for baseball, football, hockey, basketball are very popular today. Individuals purchase caps from their favor teams displaying the teams tradename with or without logo design. People collect numerous caps for memorabilia purposes, and thus, incur substantial costs in purchasing these caps.

A conventional sports cap 10 is shown in FIG. 1. The cap 10 comprises a hat portion 12 with a visor 14 connected to the hat portion 12. The hat portion 12 is constructed of six (6) pie-shaped sections 16 made of fabric sewn together along seams 18. A button 20 is sewn to the top of the hat where all six (6) pie-shaped sections meet together at their apexes. A team logo 22 is provided on the front of the cap 10 to clearly display the logo.

SUMMARY OF THE INVENTION

An object of the present invention is to provide an improved sports cap.

Another object of the present invention is to provide an improved sports cap having the capability to vary the information displayed on the cap such as team tradenames and/or logos.

A further object of the present invention is to provide an improved sports cap having a replaceable panel removably attached to the hat and bearing a team's tradename and/or logo that can be replaced with a similar panel having a different team's tradename and/or logo.

The present invention allows an individual to purchase one cap and display different team tradenames/logos on different occasions by simply changing one replaceable panel bearing a team logo with another replaceable panel bearing a different team logo, thus, saving the individual the cost related with purchasing numerous different caps. The replaceable panels can be bought at the same time with the cap or can be purchased separately, the cost of each panel being substantially less than the price of a new sports cap.

DETAILED DESCRIPTION OF PREFERRED EMBODIMENTS

Figure 1:
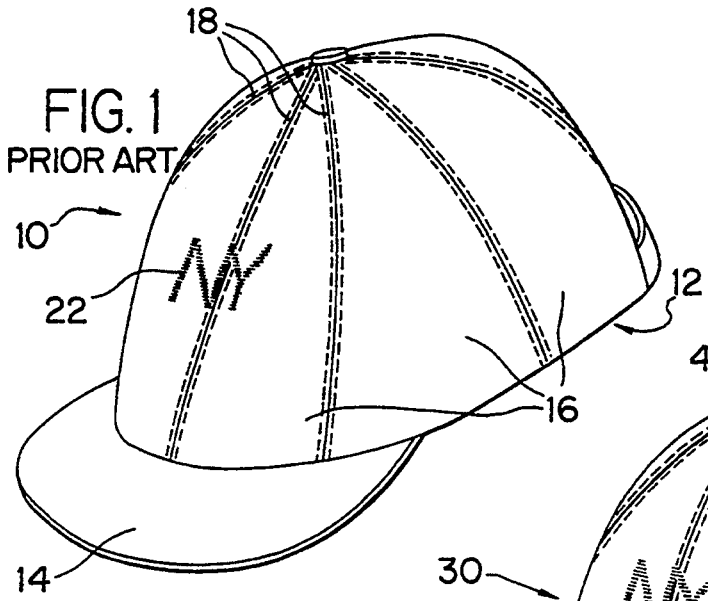
FIG. 1 PRIOR ART
FIG. 1 is a perspective view of a conventional sports cap.
Figure 2:
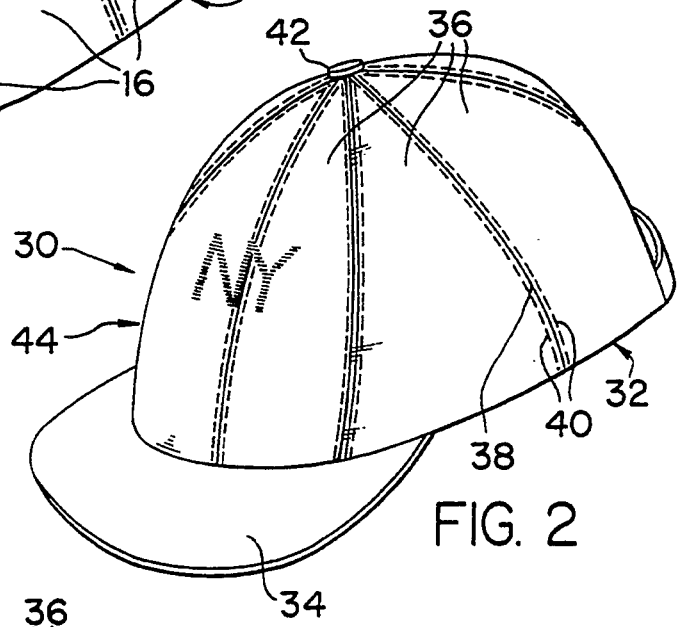
FIG. 2 is a perspective view of a sports cap according to the present invention with a replaceable tradename/logo bearing panel.
Figure 3:
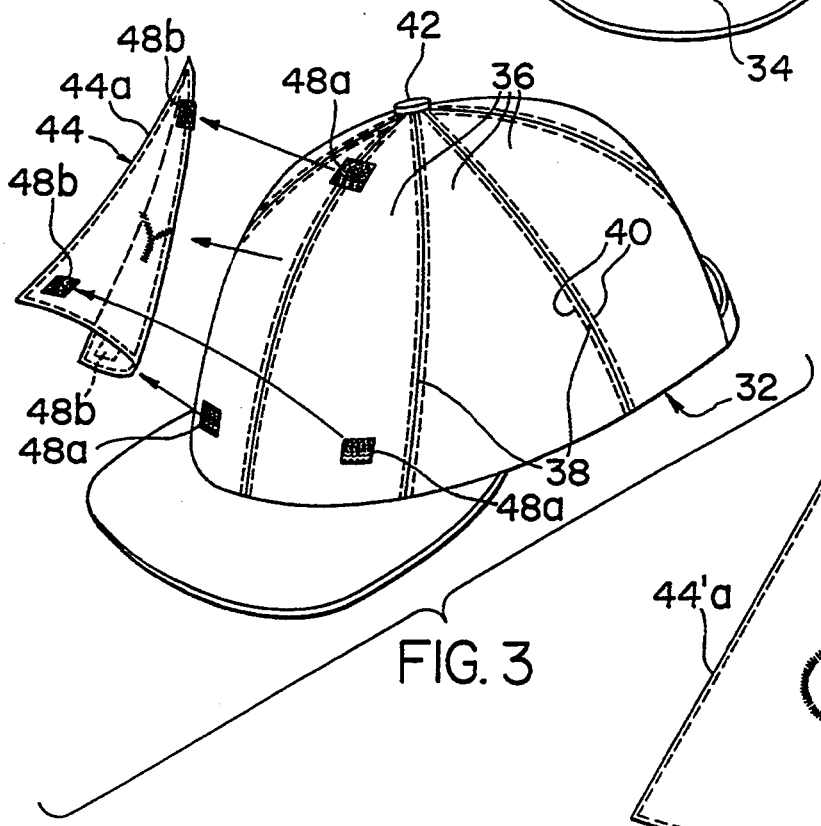
FIG. 3 is a perspective view of the sports cap shown in FIG. 2, with its replaceable panel removed.

A sports cap 30 according to the present invention is shown in FIG. 2. The cap 30 comprises a hat portion 32 with a visor 34 connected to the front of the hat portion 32. The hat portion 32 is constructed of six (6) pie-shaped sections 36 made of fabric sewn together along seams 38. The seams 38 include exposed threads 40, 40 located on either side of each seam 38. A button 42 is sewn to the top of the hat where all six (6) pie-shaped sections 36 meet together at their apexes.

A replaceable panel 44 is provided on the front of the hat portion 32. The replaceable panel 46 bears a team tradename/logo 46, which can be a logo patch sewn onto the replaceable panel 46, or threads sewn in the arrangement of a logo directly onto the replaceable panel 46. Alternatively, the tradename, logo, tradename/logo can be provide by stenciling, heat transfer printing, or other known methods of printing on fabric.

The replaceable panel 44 is removably connected to the sport cap 30, preferably to the hat portion 32. A preferred method of removably fastening the replaceable panel 44 to the hat portion 32 is by providing one or more hook and loop type fasteners such as VELCRO fasteners 48 having a component **48*a* that connects to the hat portion 32 and a component 48*b* that connects to the back of the replaceable panel 44. The VELCRO fastener components 48*a* and 48*b*** can be attached by sewing and/or the use of adhesives.

In the embodiment shown, the VELCRO fasteners 48 are arranged in a triangular pattern with three fasteners located near the apexes of the pie-shaped (i.e. almost triangular shaped) panel 44. This arrangement securely holds the two side edges **44*a* and bottom edge 44*b* of the panel in close proximity with the hat portion 32** to provide a close fit giving the same or similar appearance of a conventional cap without a removable panel. However, other suitable arrangements of the VELCRO fasteners can be utilized in the present invention.

The replaceable panel 44 can be constructed of a single pie-shape piece of fabric, however, it is preferable to use two pie-shaped pieces of fabric sewn together to simulate the standard construction of a conventional sport cap having six pie-shaped panels sewn together on their side edges.

Figure 4:
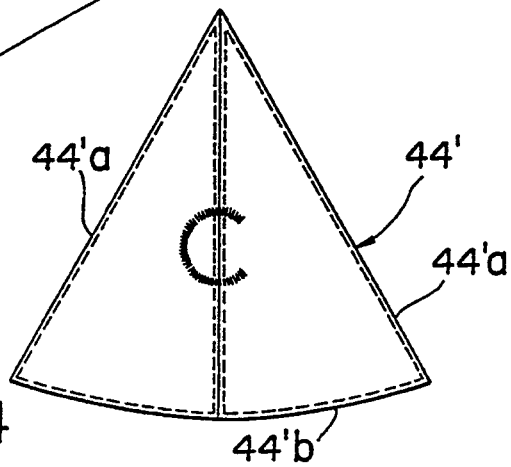
FIG. 4 is a front planar view of another replaceable panel bearing a different tradename/log.

FIG. 4 shows another replaceable panel 44' that can be substituted for the replaceable panel 44. A person purchasing a cap according to the present invention can purchase a variety of replaceable panel with different team tradenames/logos and substitute one for another on different occasions as desired.

I claim:

1. A sports cap, comprising:

a hat portion constructed of a plurality of pie-shaped portions of fabric sewn together at a plurality of seams;

a visor connected to a front portion of said hat portion;

a replaceable pie-shaped panel made of one or more pie-shaped portions of fabric, said replaceable pie-shaped panel is detachably connected to said hat portion in such a manner as to be completely removable from the sports cap;

a team trademark/logo provided on said replaceable panel; and a fastener having fastening components provided along rear edge portions of said replaceable panel and corresponding fastening components provided on said hat portion for detachably connecting said replaceable panel to said hat portion to allow said replaceable panel to be fully removed and replaced with another replaceable panel having a different team trademark/logo.

2. A cap according to claim 1, wherein said replaceable panel is removably connected to a front of said hat portion.

3. A cap according to claim 2, wherein said replaceable panel is removably connected to said hat portion with one or more hook and loop type fasteners.

4. A cap according to claim 3, wherein three hook and loop type fasteners are provided in a triangular arrangement with one positioned near a top of said replaceable panel.

5. A cap according to claim 2, wherein said hat portion is constructed of six pie-shaped portions of fabric, and said replaceable panel is constructed of two pie-shaped portions of fabric each having substantially the same size and shape as each of said six pie-shaped portions of fabric.

6. A cap according to claim 1, wherein said replaceable panel is removably connected to said hat portion with one or more hook and loop type fasteners.

7. A cap according to claim 6, wherein three hook and loop type fasteners are provided in a triangular arrangement with one positioned near a top of said replaceable panel.

8. A sports cap, comprising:

a hat portion constructed of six pie-shaped portions of fabric sewn together along their sides;

a visor connected to a front portion of said hat portion;

a replaceable pie-shaped panel constructed of two pie-shaped portions of fabric sewn together along their common sides, said replaceable pie-shaped panel is detachably connected to said hat portion in such a manner so as to be completely removable from the sports cap;

a team tradename/logo provided on said replaceable panel; and a plurality of hook and loop type fasteners with hook and loop type components connected to both said replaceable panel and said hat portion for detachably connecting said replaceable panel to said hat portion to allow said replaceable panel to be fully removed and replaced with another replaceable panel having a different team trademark/logo.

* * * * *